US006389837B1

(12) United States Patent
Morozumi

(10) Patent No.: US 6,389,837 B1
(45) Date of Patent: May 21, 2002

(54) SCROLL COMPRESSOR

(75) Inventor: Naoya Morozumi, Kawasaki (JP)

(73) Assignee: Fujitsu General Limited, Kawasaki (JP)

( * ) Notice: Subject to any disclaimer, the term of this patent is extended or adjusted under 35 U.S.C. 154(b) by 0 days.

(21) Appl. No.: 09/901,690

(22) Filed: Jul. 11, 2001

(30) Foreign Application Priority Data

Jul. 11, 2000 (JP) ..... 2000-209350

(51) Int. Cl.[7] ..... F25B 13/00; F04C 18/00

(52) U.S. Cl. ..... 62/324.6; 62/160; 62/505; 418/55.5

(58) Field of Search ..... 62/324.6, 324.1, 62/160, 505; 418/55.5

(56) References Cited

U.S. PATENT DOCUMENTS 4,496,296 A * 1/1985 Arai et al. ..... 418/55.5
5,049,044 A * 9/1991 Hirano ..... 417/310
5,256,044 A * 10/1993 Nieter et al. ..... 418/55.5
5,329,788 A * 7/1994 Caillat et al. ..... 62/505
6,202,428 B1 * 3/2001 Katayama et al. ..... 62/160
6,264,444 B1 * 7/2001 Nakane et al. ..... 418/55.3
6,276,149 B2 * 8/2001 Katayama et al. ..... 62/160

* cited by examiner

*Primary Examiner*—William Doerrler
(74) *Attorney, Agent, or Firm*—Kanesaka & Takeuchi

(57) ABSTRACT

In a scroll compressor that can switch between an internal high-pressure operation and an internal low-pressure operation, in order to provide proper back pressure for an orbiting scroll during either operation, a back pressure chamber of the orbiting scroll is divided by means of a first and a second thrust rings into a first back pressure chamber in communication with a driving chamber and an independent second back pressure chamber, and the pressure in the second back pressure chamber is set at discharge pressure or suction pressure depending on an operation mode.

20 Claims, 10 Drawing Sheets

SCROLL COMPRESSOR

TECHNICAL FIELD

The present invention relates to a scroll compressor incorporated in a reversible refrigerating cycle for an air conditioner, and more specifically, to a technique of switching between an internal high-pressure operation and an internal low-pressure operation and optimizing, during either operation, a thrust force that presses an orbiting scroll against a fixed scroll.

BACKGROUND ART

Scroll compressors comprise a refrigerant compressing section composed of a fixed scroll having a spiral wrap on a base plate and an orbiting scroll driven by an electric motor, the scrolls being engaged with each other. A low-pressure refrigerant that has completed its work during a refrigerating cycle is sucked from an outer peripheral side of the refrigerant compressing section, subsequently compressed as it approaches the center of the spiral, and then discharged as a high-pressure refrigerant from a discharge port formed in the center of the spiral.

During this refrigerant compressing operation, pressure from the interior of the refrigerant compressing section is always exerted on the orbiting scroll in a direction in which the pressure leaves the fixed scroll. Thus, such back pressure as resists the above pressure must be exerted on the orbiting scroll to prevent it from floating. A conventional example will be described with reference to FIG. 12.

In a basic configuration, the scroll compressor 1 comprises a cylindrical hermetic shell 2, and its interior is partitioned into a refrigerant discharge chamber 2*a* and a driving chamber 2*b* by means of a frame plate 3. The refrigerant discharge chamber 2*a* has a refrigerant compressing section 4 housed therein and composed of a fixed scroll 4*a* and an orbiting scroll 4*b* that are engaged with each other.

Although not shown, the driving chamber 2*b* has an electric motor housed therein and contains a predetermined amount of lubricant. A drive shaft 5 of the electric motor is extended through the frame plate 3 to the refrigerant compressing section 4 in such a manner that a crank shaft 5*a* at its tip is connected to the orbiting scroll 4*b*. The drive shaft 5 has a oil filler hole 5*b* drilled therein, and a rear surface of the orbiting scroll 4*b* and the driving chamber 2*b* are in communication with each other via the oil filler hole 5*b*.

The scroll compressor 1 as a conventional example is of an internal high-pressure type; the refrigerant discharge chamber 2*a* and the driving chamber 2*b* are in communication with each other via a communication hole 6 that penetrates the fixed scroll 4*a* and the frame plate 3.

A low-pressure refrigerant that has completed its work during a refrigerating cycle (not shown) is sucked from an outer peripheral side of the refrigerant compressing section 4 through a sucking pipe 7*a* and then discharged as a high-pressure refrigerant from a discharge port 4*c* located in a central portion of the refrigerant compressing section 4. The refrigerant is guided from the refrigerant discharge chamber 2*a* through a discharge pipe 7*b* to a four-way switching valve (not shown), with part of the refrigerant flowing through the communication hole 6 into the driving chamber 2*b*.

Thus, the pressure in the driving chamber 2*b* increases and the pressure on the rear surface of the orbiting scroll 4*b* also increases due to a flow via the oil filler hole 5*b*, but the internal pressure from the interior of the refrigerant compressing section 4 exerted on the orbiting scroll 4*b* is not uniform. That is, the apparatus exhibits a pressure gradient such that the pressure is lower on the outer peripheral side of the spiral (low-pressure refrigerant sucking side) and increases toward the center of the spiral.

To exert back pressure corresponding to this pressure gradient on the orbiting scroll 4*b*, in this conventional example, the rear surface side of the orbiting scroll 4*b* is separated into a main back pressure chamber 8*a* on the central portion side and a secondary back pressure chamber 8*b* on the peripheral portion side by means of a sealing 8 so that the high pressure in the driving chamber 2*b* is exerted in the main back pressure chamber 8*a*, while intermediate pressure, which is lower than the above high pressure, is exerted in the secondary back pressure chamber 8*b* via a throttle valve 9*a*.

A check valve 9*b* is provided between the secondary back pressure chamber 8*b* and the outer peripheral side of the spiral of the refrigerant compressing section 4 so as to allow an excess of pressure to escape toward the refrigerant compressing section 4 if the intermediate pressure in the secondary back pressure chamber 8*b* reaches a predetermined value.

In addition to the internal high-pressure type described in the conventional example, the scroll compressor includes an internal low-pressure type that sucks the low-pressure refrigerant having completed its work during the refrigerating cycle, into the driving chamber 2*b*, from which the refrigerant is guided to the refrigerant compressing section 4.

Both in the internal high- and low-pressure types, the driving chamber (electric-motor chamber) is used as a circulating path for the refrigerant in order to prevent the electric motor from being overheated. Both of these types have the following advantages and disadvantages:

The internal high-pressure type is unlikely to have its performance significantly degraded by an overheated sucked gas, while the internal low-pressure type can be started up fast because an discharged gas is not cooled in the driving chamber during a heating operation.

In the internal low-pressure type, however, the lubricant in the compressor may be discharged to a heat exchanging circuit before being separated from a refrigerant gas, thus degrading the heat exchanging capability. Further, a sliding portion of the scroll may be seized due to an insufficient amount of lubricant in the compressor. In the internal low-pressure type, the sucked refrigerant gas is passed through the electric-motor chamber and overheated therein, so that its density is likely to decrease to degrade the performance.

The applicant has proposed a scroll compressor (for example, Japanese Patent Application published under Publication No. 2000-88386) that includes the advantages of both the internal high- and low-pressure types and that can switch between two operation modes in such a manner that the compressor operates as the internal high-pressure type during a cooling operation and as the internal low-pressure type during a heating operation.

In this scroll compressor, which can switch between the internal high- and low-pressure types, the pressure in the driving chamber varies depending on the operation mode, so that the above conventional method cannot exert a proper back pressure on the orbiting scroll. That is, during the internal low-pressure operation, the pressure in the driving chamber and thus the back pressure exerted on the orbiting scroll are low, possibly causing the orbiting scroll to be separated from the fixed scroll.

SUMMARY OF THE INVENTION

The present invention is adapted to solve the above problems, and its object is to provide a scroll compressor that allows a proper back pressure to be exerted on an orbiting scroll both during an internal high-pressure operation and during an internal low-pressure operation.

To attain this object, the present invention provides a scroll compressor comprising a hermetic shell having an interior partitioned into a refrigerant discharge chamber and a driving chamber by means of a frame plate, the refrigerant discharge chamber having a refrigerant compressing section housed therein and composed of a combination of a fixed scroll and an orbiting scroll, the driving chamber provided with an electric motor for driving the orbiting scroll, the scroll compressor being capable of switching between an internal high-pressure operation mode in which a high-pressure refrigerant generated in the refrigerant compressing section is transferred from the refrigerant discharge chamber through the driving chamber to a predetermined refrigerant circuit and an internal low-pressure operation mode in which the high-pressure refrigerant generated in the refrigerant compressing section is transferred from the refrigerant discharge chamber to the refrigerant circuit and in which a low-pressure refrigerant having completed its work is sucked into the refrigerant compressing section through the driving chamber, the scroll compressor including a first back pressure chamber arranged between a rear surface of a base plate of the orbiting scroll and the frame plate and which is in communication with the driving chamber to provide pressure from the driving chamber to the base plate of the orbiting scroll as back pressure, the scroll compressor being characterized by comprising a second back pressure chamber formed independently of the first back pressure chamber and back pressure control means for varying pressure in the second pressure chamber depending on the operation mode.

In the present invention, the back pressure control means provides such control as to set low pressure in the second back pressure chamber during the internal high-pressure operation mode, while setting high pressure during the internal low-pressure operation mode.

If the refrigerant circuit comprises a reversible refrigerating cycle including a four-way switching valve, an outdoor-side heat exchanger, an expansion valve, and an indoor-side heat exchanger, ad if, during the internal high-pressure operation mode, a refrigerant flows through the refrigerant discharge chamber→the four-way switching valve →the driving chamber→the outdoor-side heat exchanger→the expansion valve→the indoor-side heat exchanger→the four-way switching valve→the refrigerant compressing section, and during the internal low-pressure operation mode, it flows through the refrigerant discharge chamber→the four-way switching valve→the indoor-side heat exchanger →the expansion valve→the outdoor-side heat exchanger→the driving chamber→the four-way switching valve→the refrigerant compressing section, then the second back pressure chamber is connected to a pipe line between the four-way switching valve and the indoor-side heat exchanger by the back pressure control means.

Further, the back pressure control means may comprise a pressure responding valve that allows the second back pressure chamber to communicate with the refrigerant discharge chamber or a suction side of the refrigerant compressing section in response to the pressure in the driving chamber.

According to a preferred embodiment of the present invention, the pressure responding valve includes a valve chest drilled in the frame plate so that one end thereof is in communication with an interior of the driving chamber, while the other end thereof is in communication with the second back pressure chamber, and a slide valve arranged in the valve chest and moving in response to the pressure in the driving chamber. The valve chest has a first port in communication with the refrigerant discharge chamber and a second port in communication with the suction side of the refrigerant compressing section, the first and second ports being formed at different locations in an axial direction, and the slide valve has a communication hole that allows one of the above ports to communicate with the second back pressure chamber.

In this case, in order to stabilize the operation of the slide valve, a spring is preferably provided in the valve chest to urge the slide valve to the first port while the operation of the compressor is stopped, and the slide valve preferably comprises a valve disc comprising two portions of different diameters including a smaller diameter portion arranged at an end thereof closer to the second back pressure chamber so that the valve can be moved against an urging force of the spring on the basis of a difference in acting pressure between the two portions of the different diameters.

During a defrosting operation when the difference between the discharge pressure and suction pressure of the compressor decreases, the spring is preferably held on the first port by the spring.

The present invention is further characterized in that in order to form the second back pressure chamber, the frame plate has a first inner peripheral surface formed thereon and located closer to the refrigerant compressing section and a second inner peripheral surface formed thereon and located closer to the driving chamber and which has a smaller diameter than the first inner peripheral surface, in that a first thrust ring and a second thrust ring are provided between the frame plate and the refrigerant compressing section, the first thrust ring comprising a cylinder having one end surface in contact with the rear surface of the base plate of the orbiting scroll and an outer peripheral surface fitted on the first inner peripheral surface, the first thrust ring being movable in the axial direction, the second thrust ring comprising a cylinder having one end surface in contact with the rear surface of the base plate of the orbiting scroll and an outer peripheral surface fitted on the second inner peripheral surface, the second thrust ring being located inside the first thrust ring and being movable in the axial direction, and in that an interior of the second thrust ring forms the first back pressure chamber and a space surrounded by the first and second thrust rings forms the second back pressure chamber.

The second thrust ring maybe configured as one ring, but in order to enable the adjustment of an area in which back pressure acts, it preferably comprises two members including a base ring having one end surface in contact with the rear surface of the base plate of the orbiting scroll and having a reduced diameter portion at the other end, which has a reduced outer diameter, and a cylindrical sub-ring that is fitted on the reduced diameter portion of the base ring and that has an outer peripheral surface fitted on the second inner peripheral surface.

The fitting seal between each of the thrust rings and the frame plate can be managed based on the clearance there between, but an elastic seal ring with a U-shaped cross section or an O ring is preferably provided in a sliding surface of each of the thrust rings which comes into contact with the corresponding inner peripheral surface of the frame plate.

The present invention is further characterized in that in order to form the second back pressure chamber, the frame plate has a first inner peripheral surface formed thereon and located closer to the refrigerant compressing section and a second inner peripheral surface formed thereon and located closer to the driving chamber and which has a smaller diameter than the first inner peripheral surface, in that a thrust ring is provided between the frame plate and the refrigerant compressing section, the thrust ring having one end surface in contact with the rear surface of the base plate of the orbiting scroll and having a large-diameter seal portion fitted on the first inner peripheral portion and a small-diameter seal portion fitted on the second inner peripheral portion, and in that an interior of the thrust ring forms the first back pressure chamber and a space between those surfaces of the large- and small-diameter seal portions which are fitted on said frame plate forms the second back pressure chamber.

Also in this case, it is preferable that an elastic seal ring be provided in a fitting surface of each of the large- and small-diameter seal portions and that elastic means be provided between the thrust ring and the frame plate to urge the thrust ring to the rear surface of the base plate of the orbiting scroll. The elastic means is preferably a wave washer.

The present invention is further characterized in that in order to form the second back pressure chamber, the frame plate has a first inner peripheral surface formed thereon and located closer to the refrigerant compressing section and a second inner peripheral surface formed thereon and located closer to the driving chamber and which has a smaller diameter than the first inner peripheral surface, in that a thrust ring is provided between the frame plate and the refrigerant compressing section, the thrust ring having one end surface in contact with a rear surface of the base plate of the orbiting scroll and having a large-diameter seal portion fitted on the first inner peripheral portion and a small-diameter seal portion fitted on the second inner peripheral portion, in that an interior of the thrust ring forms the first back pressure chamber and the second back pressure chamber is formed between those surfaces of the large- and small-diameter seal portions which are fitted on the frame plate, and in that at least two rings including an inner ring and an outer ring are concentrically formed in the one end surface of the thrust ring which is in contact with the rear surface of the base plate of the orbiting scroll so that a space is formed between the inner ring and the outer ring, with the space and the second back pressure chamber in communication with each other via a communication hole. This configuration makes it possible to reduce the pressure on a sliding surface of the thrust ring relative to the orbiting scroll.

In this configuration, the inner ring preferably has an outer diameter smaller than that of the small-diameter seal portion. With this arrangement, even if a precession temporarily occurs in which the orbiting scroll is inclined from a horizontal surface relative to the fixed scroll, a pressing force sufficient to stably recover the original position can be obtained. For a similar reason, the area circumscribed by the inner diameter of the inner ring and the outer diameter of the outer ring is preferably smaller than the cross section of the second back pressure chamber.

DETAILED DESCRIPTION

Figure 1:
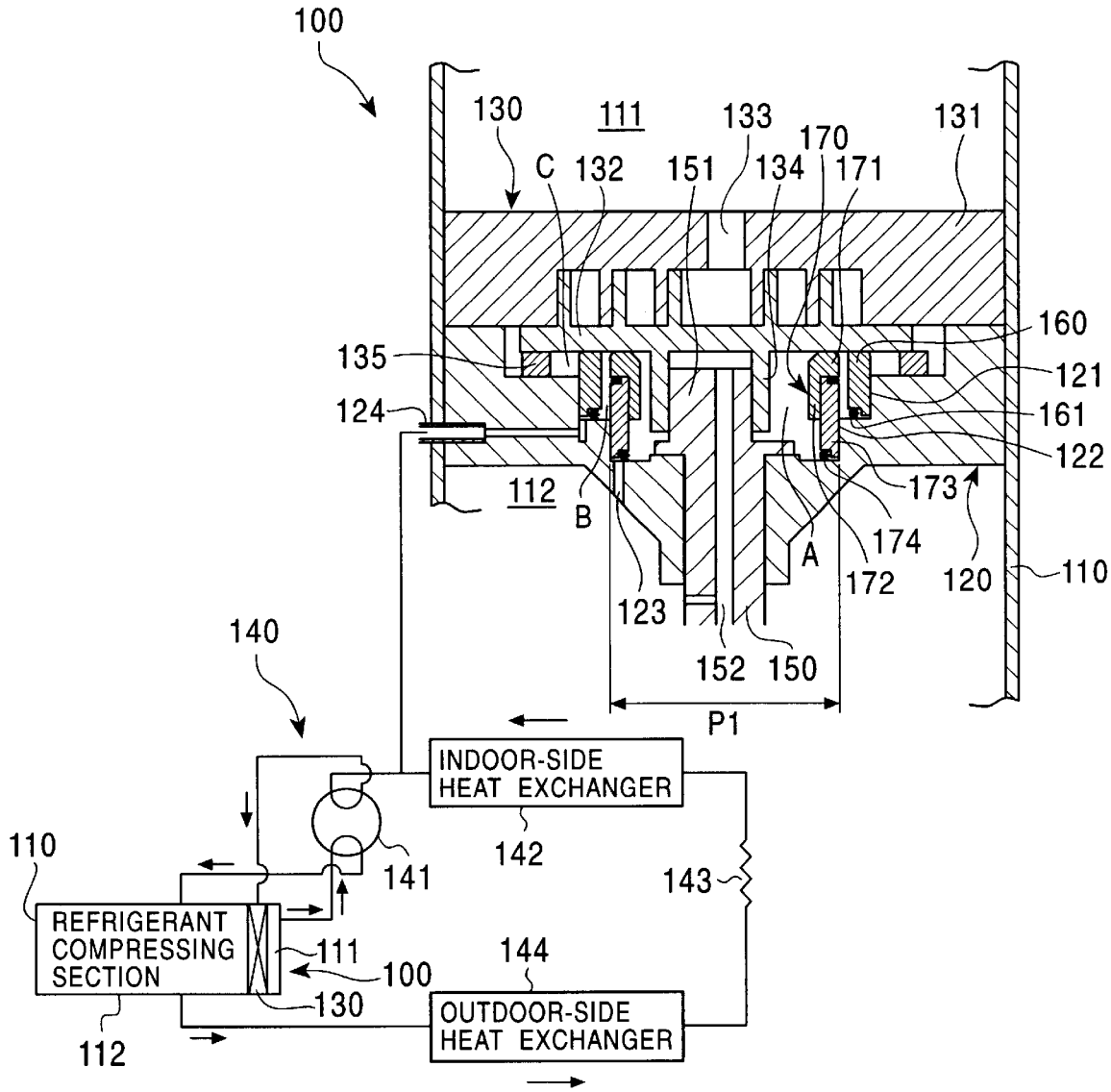
FIG. 1 is a schematic view showing an integral part of a first embodiment of the present invention and a refrigerating cycle during an internal high-pressure operation mode.
Figure 2:
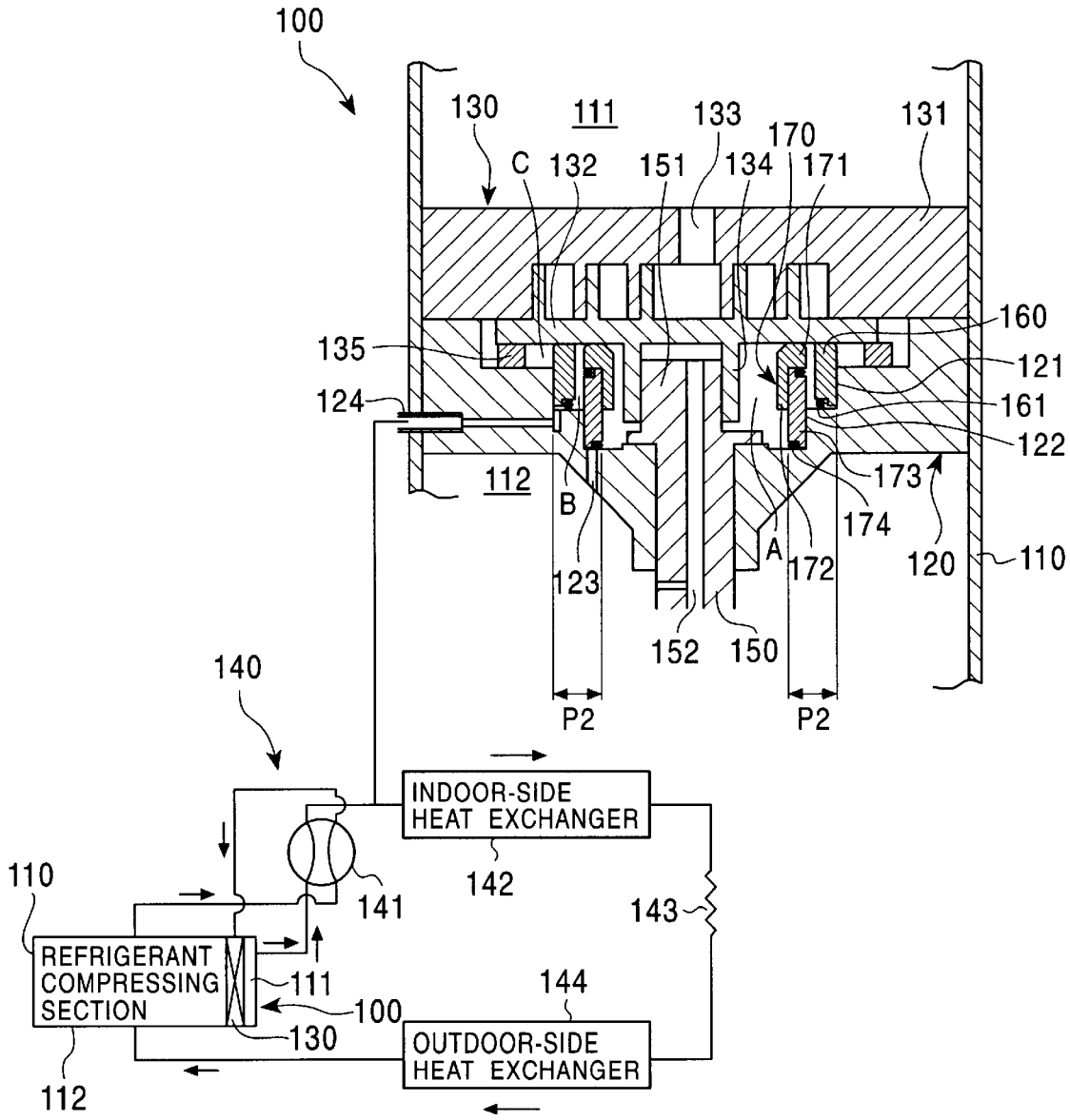
FIG. 2 is a schematic view showing the integral part of a first embodiment of the present invention and a refrigerating cycle during an internal low-pressure operation mode.
Figure 3:
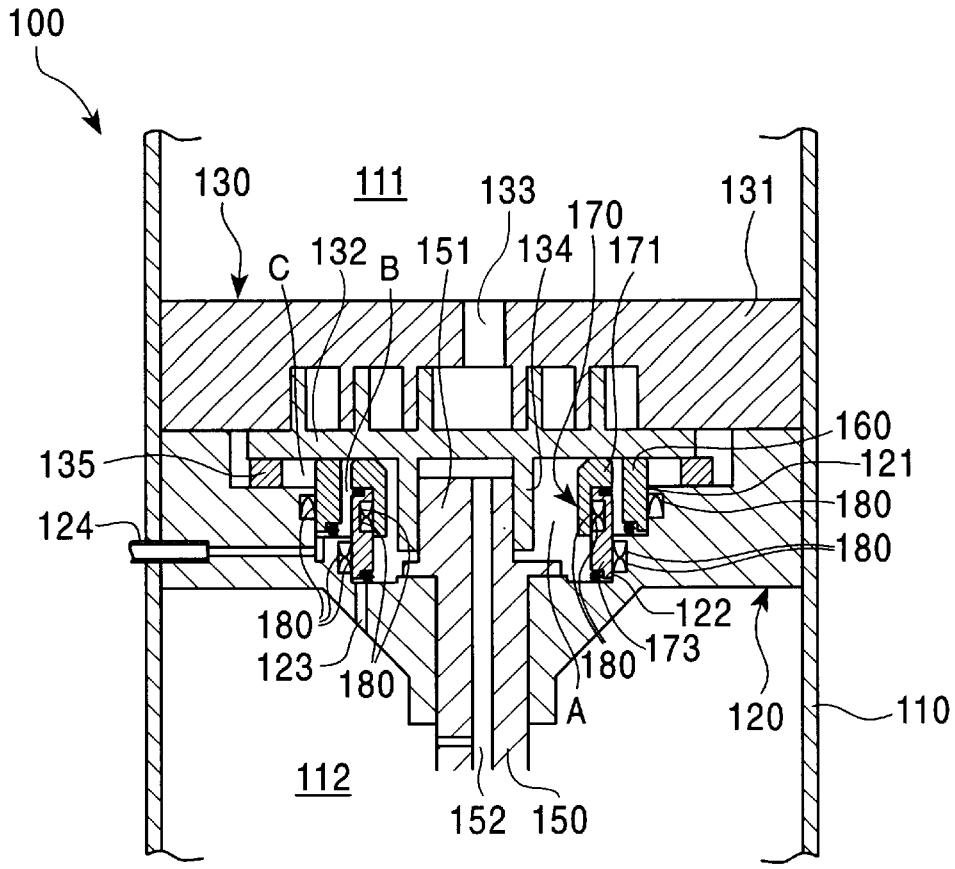
FIG. 3 is a sectional view of an integral part of the first embodiment showing its variation.

First, a first embodiment of the present invention will be described with reference to FIGS. 1 and 2. FIG. 1 shows a cross section of an integral part of a scroll compressor during an internal high-pressure operation (cooling operation) mode as well as a refrigerating cycle (refrigerating circuit). FIG. 2 shows a cross section of the integral part of the scroll compressor during an internal low-pressure operation (heating operation) mode as well as the refrigerating cycle.

The scroll compressor 100 comprises a cylindrical hermetic shell 110 that is partitioned into a refrigerant discharge chamber 111 and a driving chamber 112 by means of a frame plate 120.

The refrigerant discharge chamber 111 has a refrigerant compressing section 130 composed of a combination of a fixed scroll 131 and an orbiting scroll 132.

A refrigerant suction pipe (refrigerant return pipe) from the refrigerating cycle 140 is connected to an outer peripherals side of the spiral of the fixed scroll 131, and a discharge port 133 is formed in the center of the spiral of the fixed scroll 131.

Although not shown, the driving chamber 112 has an electric motor housed therein, and a drive shaft of the electric motor is denoted by reference numeral 150. The driving chamber 112 contains a predetermined amount of lubricant.

The drive shaft 150 of the electric motor is extended through a main bearing hole in the frame plate 120 to the refrigerant compressing section 130 in such a manner that a crank shaft 151 at its tip is fitted in a crank bearing 134 formed in the orbiting scroll 132. The drive shaft 150 has an oil filler hole 152 drilled over its length in an axial direction.

A back pressure chamber for the orbiting scroll 132 is formed between the frame plate 120 and the refrigerant compressing section 130 and includes three back pressure chambers A, B, and C.

In order to form these three back pressure chambers A, B, and C, the frame plate 120 has a first inner peripheral surface 121 located closer to the refrigerant compressing section 130 and having a large diameter, and a second inner peripheral surface 122 located closer to the driving chamber 112 and having a smaller diameter than that of the first inner peripheral surface.

A first thrust ring 160 and a second thrust ring 170 are housed between the frame plate 120 and the refrigerant compressing section 130.

The first thrust ring 160 comprises a cylinder having one end surface in contact with a rear surface of a base plate of the orbiting scroll 132 and an outer peripheral surface fitted on the first inner peripheral surface 121 of the frame plate 120; it is arranged so as to move in the axial direction. The first thrust ring 160 has a spring 161 provided at the other end thereof and acting as an auxiliary pressing means while the compressor is being activated.

Similarly, the second thrust ring 170 comprises a cylinder having one end surface in contact with the rear surface of the base plate of the orbiting scroll 132 and an outer peripheral surface fitted on the second inner peripheral surface 122 of the frame plate 120; it is arranged so as to move in the axial direction inside the first thrust ring 160.

The second thrust ring 170 may be integrally formed of one ring, but according to the first embodiment, the second thrust ring 170 comprises two members.

That is, the second thrust ring 170 comprises two members including a base ring 171 having one end surface in contact with the rear surface of the base plate of the orbiting scroll 132 and having a reduced diameter portion 172 at the other end, which has a reduced outer diameter, and a cylindrical sub-ring 173 that is fitted on the reduced diameter portion 172 of the base ring 171 and that has an outer peripheral surface fitted on the second inner peripheral surface of the frame plate 120. A spring 174 is provided between the sub-ring 173 and the frame plate 120 so as to act as an auxiliary pressing means while the compressor is being activated.

The second thrust ring 170 of a small diameter forms the first back pressure chamber A inside itself, which is normally in contact with the driving chamber 112 through the oil filler hole 152 in the drive shaft 150. The frame plate 120 has a communication hole 123 formed therein to return the oil in the first back pressure chamber A to the driving chamber 112.

The second thrust ring 170 of a small diameter and the first thrust ring 160 of a large diameter form the second back pressure chamber B there between, and the second back pressure chamber B is independent of the first back pressure chamber A in terms of pressure.

The first thrust ring 160 of a large diameter forms the third backpressure chamber C outside itself, and the third back pressure chamber C is in communication with an outer peripheral side (low pressure side) of the spiral of the fixed scroll 131. The third back pressure chamber C has an oldham-coupling ring 135 for preventing rotation of the orbiting scroll 132.

The refrigerating cycle 140 is used for an air conditioner, and includes a four-way switching valve 141, an indoor-side heat exchanger 142, an expansion valve 143, and an outdoor-side heat exchanger 144. In this case, the outdoor-side heat exchanger 144 is fixedly connected to the driving chamber 112, and the indoor-side heat exchanger 142 is selectively connected to a suction side of the refrigerant compressing section 130 or to the refrigerant discharge chamber 111 by means of the four-way switching valve 141.

In the internal high-pressure operation (cooling operation) mode shown in FIG. 1, the four-way switching valve 141 allows the refrigerant discharge chamber 111 and the driving chamber 112 to communicate with each other, and the indoor-side heat exchanger 142 is allowed to communicate with the suction side of the refrigerant compressing section 130. A refrigerant flows through the refrigerant discharge chamber 111→the four-way switching valve 141→the driving chamber 112→the outdoor-side heat exchanger 144÷the expansion valve 143→the indoor-side heat exchanger 142→the four-way switching valve 141→the refrigerant compressing section 130.

On the other hand, in the internal low-pressure operation (heating operation) mode shown in FIG. 2, the four-way switching valve 141 allows the refrigerant discharge chamber 111 and the indoor-side heat exchanger 142 to communicate with each other, and the driving chamber 112 is allowed to communicate with the suction side of the refrigerant compressing section 130. The refrigerant flows through the refrigerant discharge chamber 111→the four-way switching valve 141→the indoor-side heat exchanger 142→the expansion valve 143→the outdoor-side heat exchanger 144→the driving chamber 112→the four-way switching valve 141→the refrigerant compressing section 130.

In the first embodiment, the second back pressure chamber B is connected to the pipe line between the four-way switching valve 141 and indoor-side heat exchanger 142 of the refrigerating cycle 140. Specifically, the frame plate 120 has a connection port 124 leading to the second back pressure chamber B and to which a branch pipe branching from between the four-way switching valve 141 and the indoor-side heat exchanger 142 is connected.

According to this configuration, in the internal high-pressure operation mode, a high-pressure refrigerant is supplied to the interior of the driving chamber 112, so that the first back pressure chamber A is correspondingly set at discharge pressure. On the other hand, the refrigerant, having completed its work, is discharged from the indoor-side heat exchanger 142, and the pressure between the four-way switching valve 141 and the indoor-side heat exchanger 142 decreases down to suction pressure, so that the second back pressure chamber B is correspondingly set at low pressure.

The differential pressure between the discharge pressure from the driving chamber 112 and the suction pressure in the second back pressure chamber B acts on the sub-ring 173 of the second thrust ring 170, thereby pressing the base ring 171 against the rear surface of the base plate of the orbiting scroll 132.

In this manner, in the internal high-pressure operation mode, the differential pressure between the discharge pressure and the suction pressure, acting in the inner area of an outer peripheral seal portion of the sub-ring 173, applies a force for pressing the orbiting scroll 132 against the fixed scroll 131.

Thus, properly selecting the outer diameter (the area in which the discharge pressure acts, shown by P1 in FIG. 1) of the sub-ring 173 enables optimization of the pressing force applied to the orbiting scroll 132.

On the other hand, during the internal low-pressure operation, the driving chamber 112 is set at the suction pressure, and the first back pressure chamber A is correspondingly set at the suction pressure. On the other hand, the pressure between the four-way switching valve 141 and the indoor-side heat exchanger 142 is set at the discharge pressure. The third back pressure chamber C is maintained at the suction pressure both during the internal high-pressure operation and during the internal low-pressure operation.

Thus, the sub-ring 173 of the second thrust ring 170 is pressed against the frame plate 120, and the base ring 171 is pressed against the rear surface of the base plate of the orbiting scroll 132. The first thrust ring 160 is also pressed against the rear surface of the base plate of the orbiting scroll 132 due to the discharge pressure from the frame plate 120.

That is, during the internal low-pressure operation, the differential pressure between the discharge pressure and the suction pressure, acting in the area circumscribed by the outer diameter of the first thrust ring 160 and the outer diameter of the reduced diameter portion 172 of the base ring 171, applies a force for pressing the orbiting scroll 132 against the fixed scroll 131.

Thus, properly selecting the width (the area in which the discharge pressure acts, shown by P2 in FIG. 2) between the outer diameter of the first thrust ring 160 and the outer diameter of the reduced diameter portion 172 of the base ring 171 enables optimization of the pressing force applied to the orbiting scroll 132 during the internal low-pressure operation independently of the optimization conditions during the internal high-pressure operation.

With respect to the fitting of the thrust rings 160 and 170 on the inner peripheral surfaces 121 and 122 of the frame plate 120, the clearance there between may be managed to minimize pressure leakage, but it is preferable that grooves be formed in the inner peripheral surfaces 121 and 122 of the frame plate 120 and in the inner peripheral surface of the sub-ring 173 and that anelastic seal ring 180 having a U-shaped cross section and comprising a plate spring be provided in each of the springs.

In this case, a pair of elastic seal rings 180 facing opposite directions are preferably interposed between the sub-ring 173 and the reduced diameter portion 172 of the base ring 171 and between the sub-ring and the second inner peripheral surface 122 because the direction in which the pressure acts is reversed there between between the internal high-pressure operation and the internal low-pressure operation.

Although not particularly shown, O rings maybe used instead of the elastic seal rings 180 comprising plate springs, and such a variation is included in the present invention as an equivalent technique.

In the first embodiment, the pressure in the second back pressure chamber B is controlled by the pressure of the refrigerant in the refrigerating cycle 140, but a second embodiment for controlling the pressure in the second back pressure chamber B using a different method will be described with reference to FIGS. 4 and 5.

In the second embodiment, the discharge pressure in the refrigerant discharge chamber 111 or the suction pressure on the outer peripheral side of the spiral of the orbiting scroll 132 is introduced into the second back pressure chamber B depending on whether the operation mode is for internal high pressure or for internal low pressure. Accordingly, a pressure responding valve 190 operating in response to the pressure in the driving chamber 112 is provided.

The pressure responding valve 190 comprises a valve chest 191 drilled in the frameplate 120 in its radial direction and having a slide valve 193 housed therein. The valve chest 191 has one end in communication with the driving chamber 112 via a communication hole 192 and the other end in communication with the interior of the second back pressure chamber B.

The valve chest 191 has a first port 194 and a second port 195 provided at different locations in an axial direction of the valve chest 191. The first port 194 is located on the outer peripheral side of the frame plate 191 and leads to the refrigerant discharge chamber 111 through the frame plate 120 and the fixed scroll 131. The second port 195 is located in side the first port 194 and leads to the outer peripheral side of the spiral of the orbiting scroll 132 through the frame plate 120.

The slide valve 193 moves between a first operation position on the first port 194 side and a second operation position on the second port 195 side. The slide valve 193 comprises a communication hole 196 that selectively allows one of the ports 194 and 195 to communicate with the second back pressure chamber B at the corresponding operation position of the slide valve 193. Further, the valve chest 191 has a compression coil spring 197 that urges the slide valve 193 to the first operation position on the first port 194 side.

Figure 4:
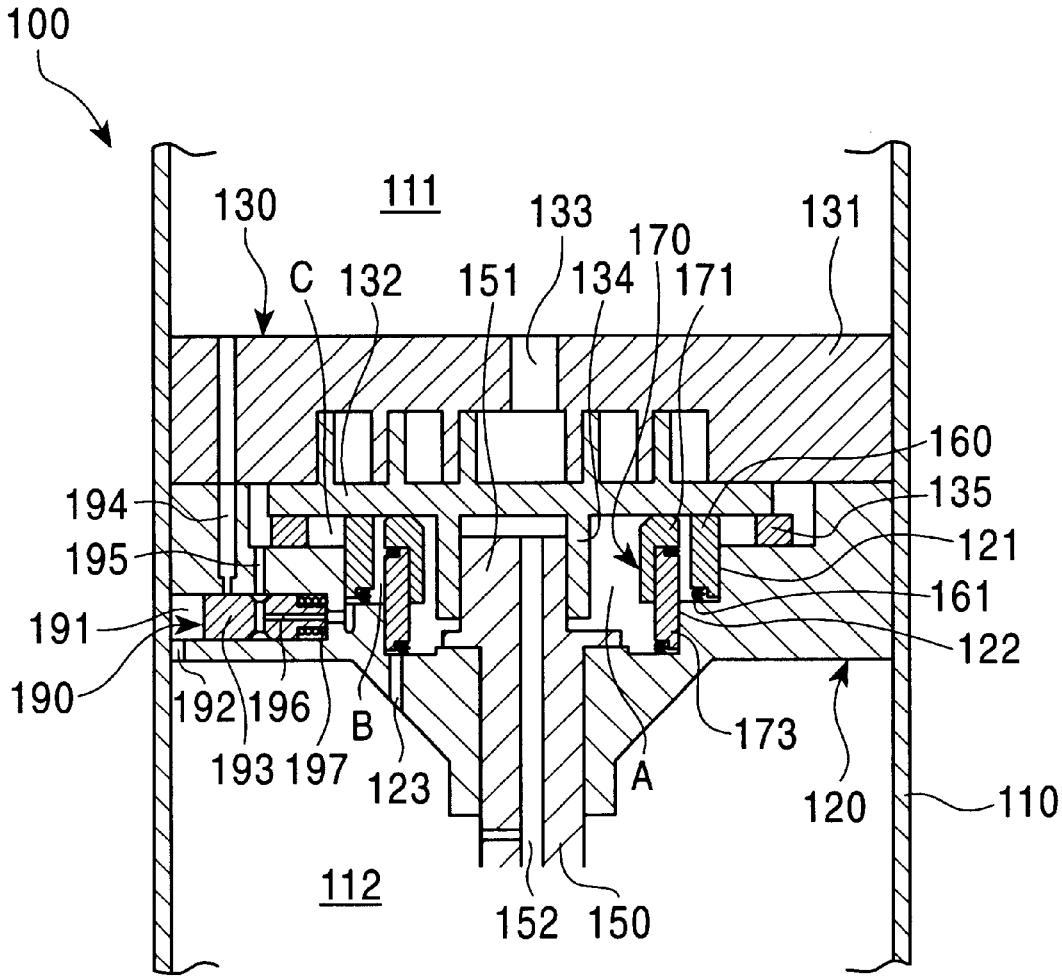
FIG. 4 is a sectional view of an integral part of a second embodiment of the present invention showing how it operates during the internal high-pressure operation mode.

The pressure responding valve 190 operates as follows: in the internal high-pressure operation (cooling operation) mode, the interior of the driving chamber 112 is set at the high discharge pressure as described in the first embodiment, so that this discharge pressure causes the slide valve 193 to move from the first operation position to the second operation position against the force of the compression coil spring 197, as shown in FIG. 4. This causes the second port 95 to be selected to allow the second back pressure chamber B to communicate with the outer peripheral side of the spiral of the orbiting scroll 132, thus setting the second back pressure chamber B at the low suction pressure.

Figure 5:
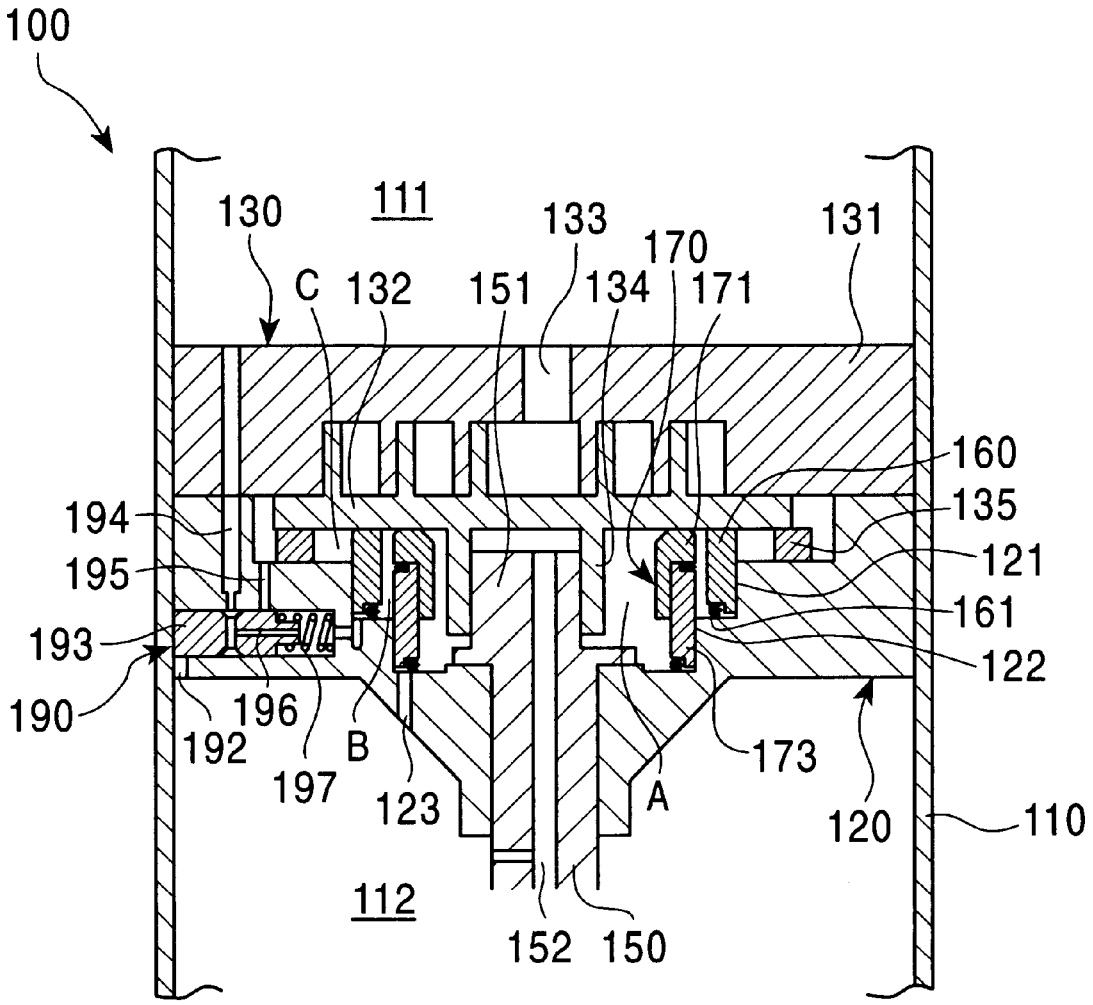
FIG. 5 is a sectional view of the integral part of the second embodiment of the present invention showing how it operates during the internal low-pressure operation mode.

On the other hand, in the internal low-pressure operation (heating operation) mode, the interior of the driving chamber 112 is set at the low suction pressure as described in the first embodiment, so that the slide valve 193 is held at the first operation position by the compression coil spring 197, as shown in FIG. 5. This causes the first port 94 to be selected to introduce the discharge pressure from the refrigerant discharge chamber 111 into the second backpressure chamber B, thus setting the second back pressure chamber B at the high pressure.

Figure 6:
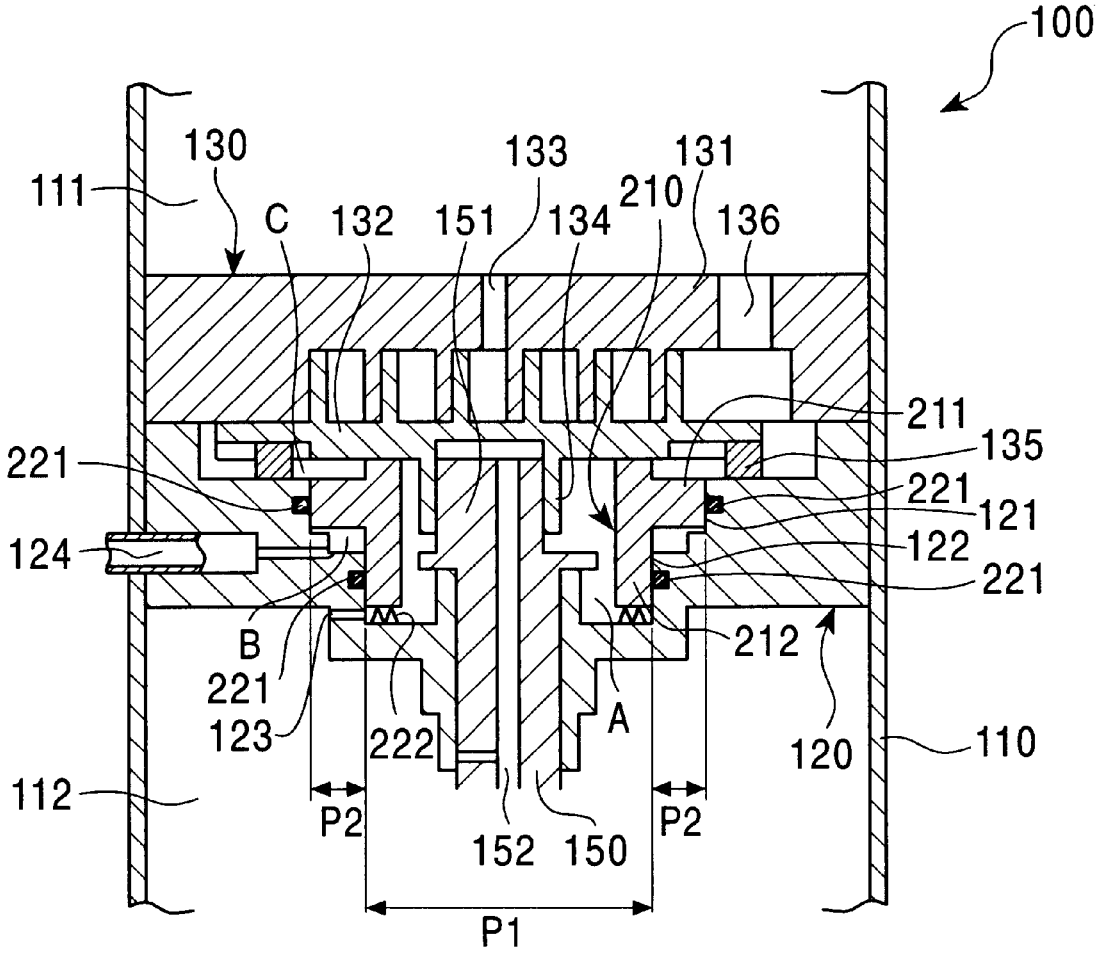
FIG. 6 is a sectional view of an integral part of a third embodiment of the present invention.

Next, a third embodiment of the present invention will be described with reference to FIG. 6. The third embodiment is a variation of the first embodiment, and the back pressure chamber of the orbiting scroll 132 is partitioned into the three back pressure chambers A, B, and C by means of one thrust ring.

That is, the first embodiment uses the two thrust rings: the first and second thrust rings 160 and 170, but in the third embodiment, only one thrust ring 210 is housed between the frame plate 120 and the refrigerant compressing section 130 so as to move in the axial direction.

The thrust ring 210 comprises a cylinder having one end surface in contact with the rear surface of the base plate of the orbiting scroll 132 and having, in a barrel portion thereof, a large-diameter seal portion 211 fitted on the first inner peripheral surface 121 of the frame plate 120 and a small-diameter seal portion 212 fitted on the second inner peripheral surface 122 of the frame plate 120.

Thus, an internal space in the thrust ring 210 constitutes the first back pressure chamber A, which is in communication with the drive chamber 112 via the communication hole 123. Further, the second backpressure chamber B is formed between those surfaces of the large-diameter seal portion 211 and small-diameter seal portion 212 which are fitted on the inner peripheral surfaces 121 and 122 of the frame plate 120.

The volume of the second back pressure chamber B may properly determined on the basis of the distance between the inner peripheral surfaces 121 and 122, a difference in diameter-wise dimension between the large-diameter seal portion 211 and the small-diameter seal portion 212, or the like. Additionally, the exterior of the thrust ring 210 forms the third back pressure chamber C, which is in communication with the outer peripheral side of the spiral of the orbiting scroll 132. In FIG. 6, a suction port in the refrigerant compressing section 130 is denoted by reference numeral 136.

According to the third embodiment, as in the first embodiment, the second back pressure chamber B is connected between the four-way switching valve 141 of the refrigerating cycle 140 and the indoor side heat exchanger 142 via the connection port 124, but O rings 221 as elastic seal members are provided in the fitting surfaces of the large-diameter seal portion 211 and small-diameter seal portion 212, and a wave washer 221 is provided at the other end of the thrust ring 210 so as to act as an auxiliary pressing means while the compressor is being activated.

The operation of this embodiment is the same as that of the first embodiment. In the internal high-pressure operation mode, the first back pressure chamber A is set at the discharge pressure, and the second back pressure chamber B is set at the suction pressure. This causes the discharge pressure, required to press the orbiting scroll 132 against the fixed scroll 131, to act in the area shown by P1 in FIG. 6, that is, inside the outer diameter of the small-diameter seal portion 212. Consequently, selection of the small-diameter seal portion 212 enables optimization of the back pressure acting on the orbiting scroll 132.

On the other hand, in the internal low-pressure operation mode, the first back pressure chamber A is set at the suction pressure, and the second back pressure chamber B is set at the discharge pressure. This causes the discharge pressure, required to press the orbiting scroll 132 against the fixed scroll 131, to act only in the area shown by P2 in FIG. 6, that is, in the space surrounded by a side surface of the small-diameter seal portion 212 and a side surface of the large-diameter seal portion 211. This force is transmitted to the orbiting scroll 132 via the thrust ring 210.

Consequently, the back pressure acting on the orbiting scroll 132 can be optimized by selecting diameters for the small- and large-diameter seal portions 212 and 211 of the thrust ring 210, whether the operation is for internal high pressure or for internal low pressure. The third back pressure chamber C is at the suction pressure in either case.

Next, a fourth embodiment of the present invention, shown in FIG. 7, will be described. In the fourth embodiment, the back pressure control means in the third embodiment is the pressure responding valve 190 described in the second embodiment, and the slide valve 193 thereof can operate more reliably.

That is, in the fourth embodiment, the slide valve 193 is formed as a valve disk comprising two portions of different diameters including a smaller-diameter portion 198 arranged at an end thereof closer to the second back pressure chamber B. As shown in FIG. 7, when the slide valve 193 is at the first operation position and the first port 194 and the second back pressure chamber B are in communication with each other, the smaller-diameter portion 198 is in communication with the second port 195 and the interior of the smaller-diameter portion 198 is set at the suction pressure.

When the operation is stopped, that is, without any difference between the discharge pressure and the suction pressure, the slide valve 193 is held at the first operation position (initial position) by the compression coil spring 197.

In this state, when the internal high-pressure operation is started, the difference in pressure between the larger-diameter portion (valve main body) and smaller-diameter portion 198 of the slide valve 193 gradually increases. When the difference in pressure overcomes the spring force of the compression coil spring 197, the slide valve 193 moves from the first operation position to the second operation position, which is shown in the right of FIG. 7, and the second port 195 and the second back pressure chamber B are allowed to communicate with each other to set the second back pressure chamber B at the suction pressure.

During the internal low-pressure operation, the suction pressure is exerted on both ends of the slide valve 193, so that the difference in cross section between the larger-diameter portion and the smaller-diameter portion 198 causes a force to act on the slide valve 193 in the same direction as that of the pressing force applied to the compression coil spring 197, thereby holding the slide valve 193 at its initial position. Consequently, the second back pressure chamber B is kept in communication with the first port 194 and thus has its interior maintained at the discharge pressure.

Under operational conditions in which the difference between the discharge pressure and the suction pressure is small, such as during a defrosting operation, the backpressure acting on the orbiting scroll is lower than that during a rated operation, so that the orbiting scroll is separated from the fixed scroll, thus increasing a leakage loss in the refrigerant compressing section.

To prevent this, the present invention sets the pressing force of the compression coil spring 197 so as to hold the slide valve 193 at its initial position even during such an operation that the difference between the discharge pressure and the suction pressure is small.

Figure 7:
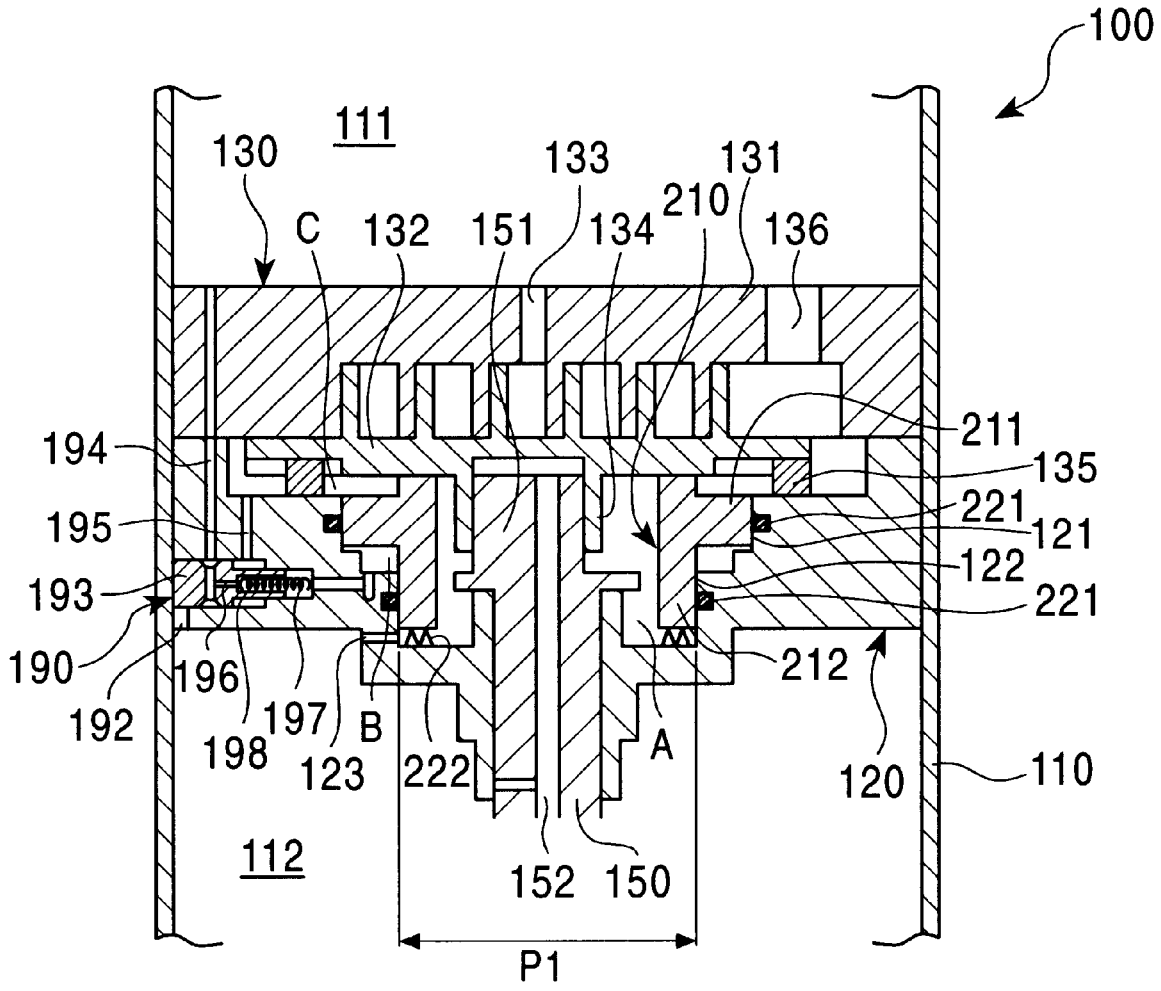
FIG. 7 is a sectional view of an integral part of a fourth embodiment of the present invention.

With this configuration, the area shown by P1 in FIG. 7, that is, all the area inside the large-diameter seal portion 211 of the thrust ring 210 can be set at the discharge pressure, thereby allowing proper back pressure to be exerted on the orbiting scroll 132 even during the defrosting operation or the like.

Figure 8:
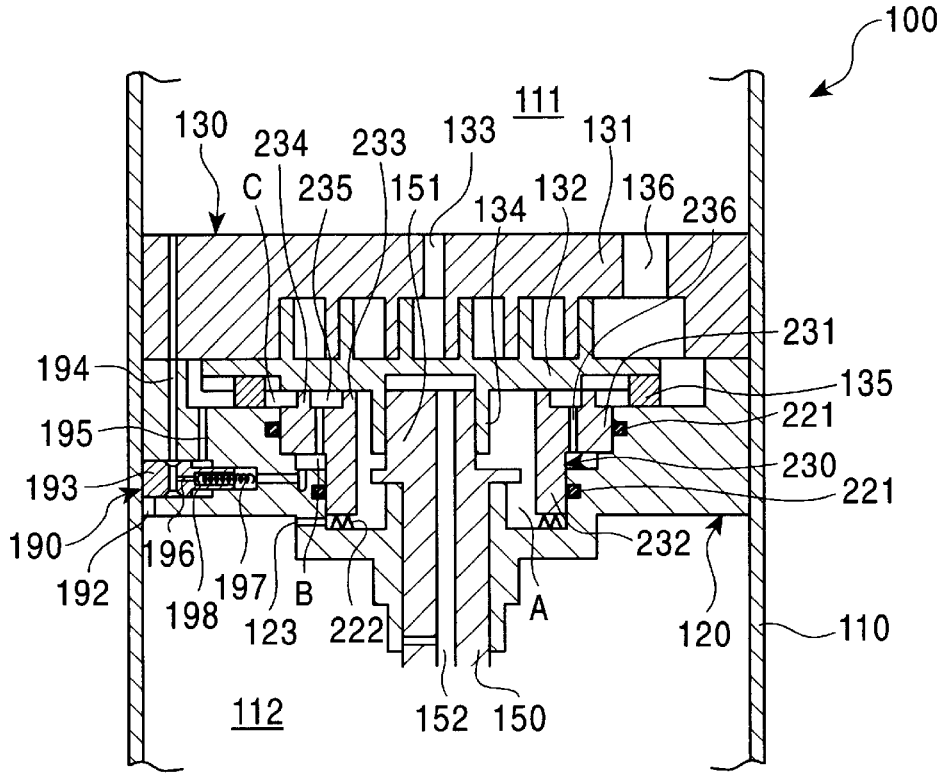
FIG. 8 is a sectional view of an integral part of a fifth embodiment of the present invention.

Next, a fifth embodiment, shown in FIG. 8, will be described. The fifth embodiment reduces the sliding surface pressure between the thrust ring and the orbiting scroll. The fifth embodiment differs from the other embodiments principally in the configuration of the thrust ring, but is the same as them in terms of the other components.

The fifth embodiment includes an integral thrust ring 230 similar to the thrust ring 210 used in the fourth embodiment.

That is, the thrust ring 230 comprises a cylinder including a large-diameter seal portion 231 and a small-diameter seal portion 232, and the backpressure chamber of the orbiting scroll 132 is partitioned into the first back pressure chamber A, the second back pressure chamber B, and the third back pressure chamber C. The second back pressure chamber B is set at the discharge pressure or the suction pressure by the pressure responding valve 190 as in the fourth embodiment.

Figure 9:
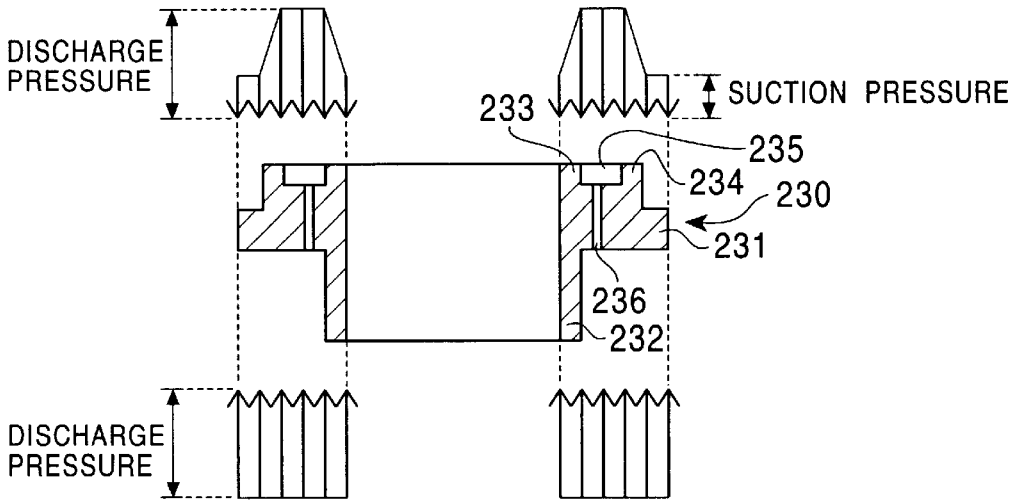
FIG. 9 is an explanatory representation showing the gradient of pressure acting on a thrust ring during the internal low-pressure operation according to the fifth embodiment.

The thrust ring 230 is arranged in the back pressure chamber of the orbiting scroll 132 so as to move in the axial direction until one end surface thereof comes into contact with the rear surface of the base plate of the orbiting scroll 132. The one end surface has an inner ring 233 and an outer ring 234 concentrically formed therein so that a space 235 is formed between these rings, as shown in FIG. 9. The space 235 is in communication with the second back pressure chamber B via the communication hole 236.

During the internal low-pressure operation, the second back pressure chamber B is set at the discharge pressure by the pressure responding valve 190, but according to the fifth embodiment, part of the discharge pressure is introduced into the space 235. Since the space 235 is substantially closed by the base plate of the orbiting scroll 132, the introduced discharge pressure acts in such a manner as to push the thrust ring 230 back to the frame plate 120.

This reduces the pressure on the sliding seal surface of the thrust ring 230 relative to the orbiting scroll 132. The arrows in FIG. 9 show the gradient of pressure acting on the thrust ring 230.

FIG. 9 shows a linear gradient of pressure on the sliding seal surface, but during actual operations, the pressure gradient is not always linear due to a precession of the orbiting scroll 132 (the orbiting scroll 132 is inclined from a horizontal surface relative to the fixed scroll 131, that is, a force that separates the orbiting scroll 132 from the fixed scroll 131 becomes predominant to cause the orbiting scroll 132 to orbit without being completely pressed against the fixed scroll 131), and the gas pressure acting on the sliding surface may substantially equal the discharge pressure.

Figure 10:
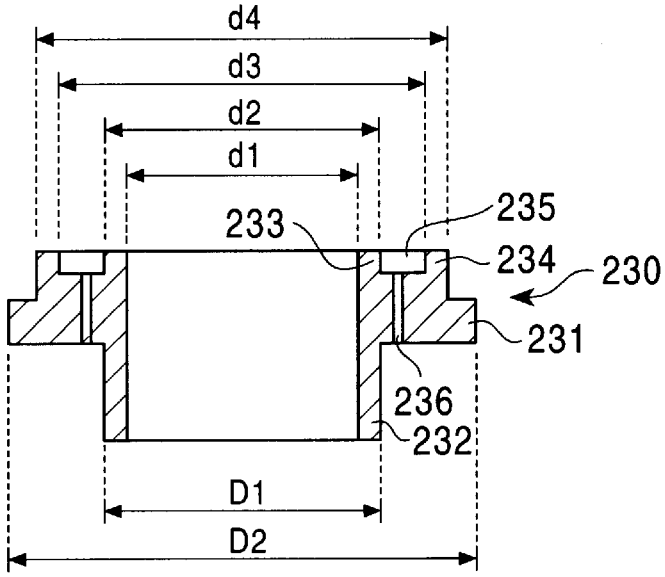
FIG. 10 is an explanatory representation showing the dimension of the diameter of the thrust ring according to the fifth embodiment.

In this case, when the area circumscribed by the inner diameter dl of the inner ring 233 and the outer diameter d4 of the outer ring 234 as shown in FIG. 10 is larger than the cross section (between the outer diameter D1 of the small-diameter seal portion 232 and the outer diameter D2 of the large-diameter seal portion 231) of the back pressure chamber B, the thrust ring 230 and the orbiting scroll 132 may be separated from each other, thus degrading the seal on the sliding surface to thereby increase the loss of the compressor.

Thus, in the present invention, the area circumscribed by the inner diameter dl of the inner ring 233 and the outer diameter d4 of the outer ring 234 is smaller than the cross section of the second back pressure chamber B so that even if the orbiting scroll 132 is temporarily in precession, a pressing force sufficient to recover its stable state can be obtained.

Figure 11:
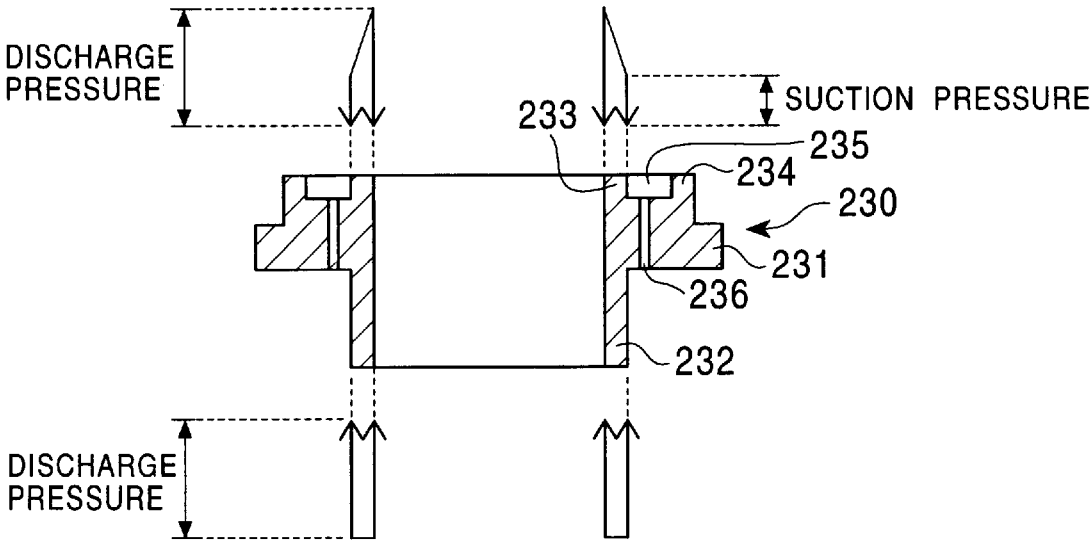
FIG. 11 is an explanatory representation showing the gradient of pressure acting on the thrust ring during the internal high-pressure operation according to the fifth embodiment.
Figure 12:
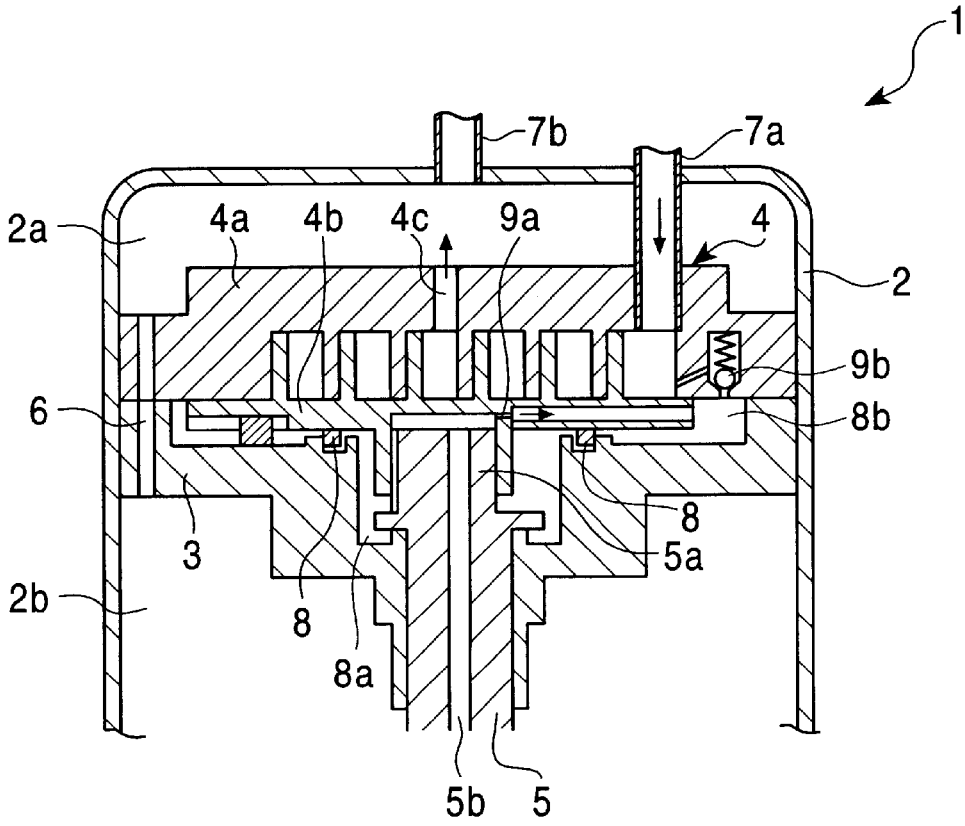
FIG. 12 PRIOR ART
FIG. 12 is a sectional view of an integral part of a conventional example.

Further, during the internal high-pressure operation, the second back pressure chamber B is set at the suction pressure by the pressure responding valve 190, so the gradient of pressure acting on the thrust ring 230 is as shown in FIG. 11. Also during the internal high-pressure operation, if the orbiting scroll 132 is temporarily in precession, the pressure on the sliding surface between the inner ring 233 and the orbiting scroll 132 becomes almost equal to the discharge pressure. When, however, the outer diameter d2 of the inner ring 233 is smaller than the outer diameter D1 of the small-diameter seal portion 232 of the thrust ring 230, a pressing force sufficient to recover the orbiting scroll 132 from precession to its stable state can be obtained.

Although the fifth embodiment uses the pressure responding valve 190 as a back pressure control means of the second back pressure chamber B, the pressure in the second back pressure chamber B may be controlled by means of the refrigerating cycle 140 as in the above described first embodiment.

As described above, according to the present invention, in the scroll compressor that can switch between the internal high-pressure operation and the internal low-pressure operation, the back pressure chamber for the orbiting scroll is divided into a plurality of chambers so that the pressure in a particular one of the resulting chambers can be controlled to the discharge pressure or the suction pressure according to the operation made, thus enabling a proper back pressure to be exerted on the orbiting scroll, whether the operation is for internal high pressure or for internal low pressure.

Further, according to the present invention, the pressure in a particular back pressure chamber can be controlled by means of the pressure responding valve operating in response to the pressure in the driving chamber or by means of the pressure from the refrigerating cycle. Moreover, according to the present invention, the scroll compressor can be configured using one integral thrust ring, thus simplifying the structure. Further, according to the present invention, the pressure on the sliding surface of the thrust ring relative to the orbiting scroll can be adjusted properly.

Although the present invention has been described in detail in connection with the specific embodiments, it is to be understood that changes, modifications, and equivalent techniques easily achieved by those skilled in the art after understanding the above described contents may be included in the scope of the present invention as set forth in the claims.

What is claimed is:

1. A scroll compressor comprising a hermetic shell having an interior partitioned into a refrigerant discharge chamber and a driving chamber by means of a frame plate, said refrigerant discharge chamber having a refrigerant compressing section housed therein and composed of a combination of a fixed scroll and an orbiting scroll, said driving chamber provided with an electric motor for driving the orbiting scroll, the scroll compressor being capable of switching between an internal high-pressure operation mode in which a high-pressure refrigerant generated in said refrigerant compressing section is transferred from said refrigerant discharge chamber through said driving chamber to a predetermined refrigerant circuit and an internal low-pressure operation mode in which the high-pressure refrigerant generated in said refrigerant compressing section is transferred from said refrigerant discharge chamber to said refrigerant circuit and in which a low-pressure refrigerant having completed its work is sucked into said refrigerant compressing section through said driving chamber, and the scroll compressor including a first back pressure chamber arranged between a rear surface of a base plate of said orbiting scroll and said frame plate and which is in communication with said driving chamber to provide pressure from the driving chamber to said base plate of said orbiting scroll as back pressure, the scroll compressor being characterized by further comprising:

a second back pressure chamber formed independently of said first back pressure chamber and back pressure control means for varying pressure in said second pressure chamber depending on said operation mode.

2. The scroll compressor according to claim 1, characterized in that said back pressure control means sets low pressure in said second back pressure chamber during said internal high-pressure operation mode, while setting high pressure during said internal low-pressure operation mode.

3. The scroll compressor according to claim 1, characterized in that said refrigerant circuit comprises a reversible refrigerating cycle including a four-way switching valve, an outdoor-side heat exchanger, an expansion valve, and an indoor-side heat exchanger, in that:

during said internal high-pressure operation mode, a refrigerant flows through said refrigerant discharge chamber→said four-way switching valve→said driving chamber→said outdoor-side heat exchanger→said expansion valve→said indoor-side heat exchanger→said four-way switching valve→said refrigerant compressing section, and during said internal low-pressure operation mode, the refrigerant flows through said refrigerant discharge chamber→said four-way switching valve→said indoor-side heat exchanger→said expansion valve→said outdoor-side heat exchanger said driving chamber→said four-way switching valve→said refrigerant compressing section, and in that:

said back pressure control means connects said second back pressure chamber to a pipe line between said four-way switching valve and said indoor-side heat exchanger.

4. A scroll compressor according to claim 1, characterized in that said back pressure control means comprises a pressure responding valve that allows said second back pressure chamber to communicate with said refrigerant discharge chamber or a suction side of said refrigerant compressing section in response to the pressure in said driving chamber.

5. A scroll compressor according to claim 4, characterized in that said pressure responding valve includes a valve chest drilled in said frame plate so that one end thereof is in communication with an interior of said driving chamber, while the other end thereof is in communication with said second back pressure chamber, and a slide valve arranged in said valve chest and moving in response to the pressure in said driving chamber, in that said valve chest has a first port in communication with said refrigerant discharge chamber and a second port in communication with the suction side of said refrigerant compressing section, said first and second ports being formed at different locations in an axial direction, and in that said slide valve has a communication hole that allows one of said ports to communicate with said second back pressure chamber.

6. A scroll compressor according to claim 5, characterized in that a spring is provided in said valve chest to urge said slide valve to said first port while operation of said compressor is stopped.

7. A scroll compressor according to claim 6, characterized in that said slide valve comprises a valve disc comprising two portions of different diameters including a smaller diameter portion arranged at an end thereof closer to said second back pressure chamber so that said valve can be moved against an urging force of said spring on the basis of a difference in acting pressure between the two portions of the different diameters.

8. A scroll compressor according to claim 6, characterized in that during a defrosting operation in which the difference between the discharge pressure and suction pressure of the compressor is small, said slide valve is held on said first port by said spring.

9. A scroll compressor according to claim 1, characterized in that said frame plate has a first inner peripheral surface formed thereon and located closer to said refrigerant compressing section and a second inner peripheral surface formed thereon and located closer to said driving chamber and which has a smaller diameter than that of said first inner peripheral surface, in that:

a first thrust ring and a second thrust ring are provided between said frame plate and said refrigerant compressing section, said first thrust ring comprising a cylinder having one end surface in contact with the rear surface of the base plate of said orbiting scroll and an outer peripheral surface fitted on said first inner peripheral surface, said first thrust ring being movable in the axial direction, said second thrust ring comprising a cylinder having one end surface in contact with the rear surface of the base plate of said orbiting scroll and an outer peripheral surface fitted on said second inner peripheral surface, said second thrust ring being located inside said first thrust ring and being movable in the axial direction, and in that:

an interior of said second thrust ring forms said first back pressure chamber and a space surrounded by said first and second thrust rings forms said second back pressure chamber.

10. A scroll compressor according to any of claim 9, characterized in that said second thrust ring comprises two members including a base ring having one end surface in contact with the rear surface of the base plate of said orbiting scroll and having a reduced diameter portion at the other end, which has a reduced outer diameter, and a cylindrical sub-ring that is fitted on the reduced diameter portion of said base ring and that has an outer peripheral surface fitted on said second inner peripheral surface.

11. A scroll compressor according to claim 9, characterized in that an elastic seal ring is provided in a sliding surface of each of the thrust rings which comes into contact with the corresponding inner peripheral surface of said frame plate.

12. A scroll compressor according to claim 11, characterized in that said elastic seal ring is an O ring.

13. A scroll compressor according to claim 10, characterized in that a pair of elastic seal rings with a U-shaped cross section are provided between said base ring and said sub-ring and between the sub-ring and the second inner peripheral surface of said frame plate.

14. A scroll compressor according to claim 1, characterized in that said frame plate has a first inner peripheral surface formed thereon and located closer to said refrigerant compressing section and a second inner peripheral surface formed thereon and located closer to said driving chamber and which has a smaller diameter than that of said first inner peripheral surface, in that:

a thrust ring is provided between said frame plate and said refrigerant compressing section, said thrust ring having one end surface in contact with a rear surface of said base plate of said orbiting scroll and having a large-diameter seal portion fitted on said first inner peripheral portion and a small-diameter seal portion fitted on said second inner peripheral portion, and in that:

an interior of said thrust ring forms said first back pressure chamber and a space between surfaces of said large- and small-diameter seal portions which are fitted on said frame plate forms said second back pressure chamber.

15. A scroll compressor according to claim 14, characterized in that an elastic seal ring is provided in a fitting surface of each of said large- and small-diameter seal portions.

16. A scroll compressor according to claim 14, characterized in that elastic means is provided between said thrust ring and said frame plate to urge said thrust ring to the rear surface of the base plate of said orbiting scroll.

17. A scroll compressor according to claim 16, characterized in that said elastic means is a wave washer.

18. A scroll compressor according to claim 1, characterized in that said frame plate has a first inner peripheral surface formed thereon and located closer to said refrigerant compressing section and a second inner peripheral surface formed thereon and located closer to said driving chamber and which has a smaller diameter than that of said first inner peripheral surface, in that:

a thrust ring is provided between said frame plate and said refrigerant compressing section, said thrust ring having one end surface in contact with the rear surface of the base plate of said orbiting scroll and having a large-diameter seal portion fitted on said first inner peripheral portion and a small-diameter seal portion fitted on said second inner peripheral portion, in that:

an interior of said thrust ring forms said first back pressure chamber and said second back pressure chamber is formed between those surfaces of said large- and small-diameter seal portions which are fitted on said frame plate, and in that:

at least two rings including an inner ring and an outer ring are concentrically formed in the one end surface of said thrust ring which is in contact with the rear surface of the base plate of said orbiting scroll so that a space is formed between the inner ring and the outer ring, with said space and said second back pressure chamber in communication with each other via a communication hole.

19. A scroll compressor according to claims 18, characterized in that said inner ring has a smaller outer diameter than that of said small-diameter seal portion.

20. A scroll compressor according to claim 18, characterized in that an area circumscribed by the inner diameter of said inner ring and the outer diameter of said outer ring is smaller than a cross section of said second back pressure chamber.

* * * * *